US007836607B2

(12) United States Patent
Kim

(10) Patent No.: US 7,836,607 B2
(45) Date of Patent: Nov. 23, 2010

(54) DRUM OF LAUNDRY DRYER

(75) Inventor: Chang Wook Kim, Masan-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/567,850

(22) PCT Filed: May 25, 2005

(86) PCT No.: PCT/KR2005/001539

§ 371 (c)(1),
(2), (4) Date: Feb. 10, 2006

(87) PCT Pub. No.: WO2005/121436

PCT Pub. Date: Dec. 22, 2005

(65) Prior Publication Data

US 2007/0068034 A1 Mar. 29, 2007

(30) Foreign Application Priority Data

Jun. 5, 2004 (KR) ..... 10-2004-0041111

(51) Int. Cl.
*F26B 25/00* (2006.01)

(52) U.S. Cl. ..... 34/595; 34/602; 34/603; 34/606; 34/201; 34/218; 34/242; 34/134; 68/142; 165/158; 206/524.8; 62/421; 52/302.1; 8/142

(58) Field of Classification Search ..... 34/595, 34/602, 603, 606, 201, 218, 242; 68/142; 165/158; 206/524.8; 62/421; 52/302.1; 8/142

See application file for complete search history.

(56) References Cited

U.S. PATENT DOCUMENTS

| | | | | | |
|---|---|---|---|---|---|
| 857,161 | A | * | 6/1907 | Cummer | 432/109 |
| 1,169,782 | A | * | 2/1916 | Eden | 68/142 |
| 1,364,827 | A | * | 1/1921 | Behr | 118/301 |
| 1,479,864 | A | * | 1/1924 | Martin | 312/34.13 |
| 1,641,554 | A | * | 9/1927 | Scott | 66/13 |
| 1,647,713 | A | * | 11/1927 | Olson | 192/135 |
| 1,655,514 | A | * | 1/1928 | Seifert | 34/601 |
| 1,674,171 | A | * | 6/1928 | Gammeter et al. | 156/193 |
| 1,713,575 | A | * | 5/1929 | Warwick | 177/1 |
| 1,745,707 | A | * | 2/1930 | Perrett | 137/565.14 |
| 1,762,594 | A | * | 6/1930 | Seifert | 34/606 |
| 1,792,137 | A | * | 2/1931 | Bethke | 366/225 |
| 1,914,954 | A | * | 6/1933 | Miller | 66/43 |
| 1,945,890 | A | * | 2/1934 | Gaskell | 140/112 |

(Continued)

FOREIGN PATENT DOCUMENTS

DE 4326496 A1 * 2/1995

(Continued)

*Primary Examiner*—Stephen M. Gravini
(74) *Attorney, Agent, or Firm*—McKenna Long & Aldrige LLP

(57) ABSTRACT

A drum assembly of a laundry dryer includes a cylindrical drum main body formed through a seam-welding process, a drum head including a main head rim having a predetermined width in a direction toward a center of the drum main body, the main head rim being coupled to a first end of the drum main body and provided with a plurality of elevated portion, and a support sleeve bent from an end of the main head rim, a drum rear wall coupled to a second end of the drum main body and provided with a plurality of hot wind introducing holes, and a lift coupled to an inner circumference of the drum main body to lift the laundry.

12 Claims, 3 Drawing Sheets

U.S. PATENT DOCUMENTS

| | | | | | |
|---|---|---|---|---|---|
| 1,965,480 | A | * | 7/1934 | Stramaglia | 34/599 |
| 2,026,189 | A | * | 12/1935 | Purkett | 34/601 |
| 2,028,078 | A | * | 1/1936 | State et al. | 156/365 |
| 2,078,801 | A | * | 4/1937 | Lewis | 425/110 |
| 2,096,217 | A | * | 10/1937 | Vaughan, Jr. | 66/36 |
| 2,108,084 | A | * | 2/1938 | Strobridge | 34/610 |
| 2,201,068 | A | * | 5/1940 | Wintritz | 29/410 |
| 2,252,181 | A | * | 8/1941 | Hunter et al. | 34/122 |
| 2,262,186 | A | * | 11/1941 | Lindberg | 34/607 |
| 2,297,694 | A | * | 10/1942 | Dunham | 68/12.19 |
| 2,299,458 | A | * | 10/1942 | Chandler et al. | 242/533.7 |
| 2,315,354 | A | * | 3/1943 | Shanman | 34/82 |
| 2,330,421 | A | * | 9/1943 | Haberstump | 68/144 |
| 2,370,120 | A | * | 2/1945 | Bousman | 210/531 |
| 2,372,790 | A | * | 4/1945 | Morgenstern | 34/609 |
| 2,382,843 | A | * | 8/1945 | Annis | 73/465 |
| 2,393,380 | A | * | 1/1946 | Jorgenson et al. | 34/605 |
| 2,413,601 | A | * | 12/1946 | Gottlob Bitzer | 66/96 W |
| 2,434,886 | A | * | 1/1948 | Pugh | 34/60 |
| 2,451,403 | A | * | 10/1948 | Newbery | 68/27 |
| 2,486,058 | A | * | 10/1949 | Patterson et al. | 34/82 |
| 2,498,172 | A | * | 2/1950 | Mintner et al. | 432/107 |
| 2,521,712 | A | * | 9/1950 | Geldhof | 34/82 |
| 2,539,407 | A | * | 1/1951 | Dinley | 34/74 |
| 2,540,955 | A | * | 2/1951 | Moore | 34/605 |
| 2,547,238 | A | * | 4/1951 | Tremblay | 34/603 |
| 2,553,581 | A | * | 5/1951 | Hatfield | 68/12.14 |
| 2,608,769 | A | * | 9/1952 | O'Neil | 34/131 |
| 2,633,646 | A | * | 4/1953 | Smith | 34/425 |
| 2,642,080 | A | * | 6/1953 | Fitzgerald | 137/387 |
| 2,644,245 | A | * | 7/1953 | Hammell et al. | 34/547 |
| 2,648,142 | A | * | 8/1953 | Shapter | 34/82 |
| 2,673,727 | A | * | 3/1954 | Smith | 432/107 |
| 2,688,806 | A | * | 9/1954 | Long | 34/75 |
| 2,690,660 | A | * | 10/1954 | Miller | 66/96 R |
| 2,699,660 | A | * | 1/1955 | Kirby | 68/23.3 |
| 2,707,837 | A | * | 5/1955 | Paulsen et al. | 34/607 |
| 2,722,750 | A | * | 11/1955 | Smith et al. | 34/82 |
| 2,722,751 | A | * | 11/1955 | Steward | 34/82 |
| 2,723,331 | A | * | 11/1955 | Tyrner | 219/137.71 |
| 2,728,481 | A | * | 12/1955 | Robinson et al. | 220/4.02 |
| 2,748,496 | A | * | 6/1956 | Hellyer | 34/603 |
| 2,750,782 | A | * | 6/1956 | Hamell, Jr. | 68/140 |
| 2,764,820 | A | * | 10/1956 | Kaufman, II | 34/79 |
| 2,783,549 | A | * | 3/1957 | Young | 34/83 |
| 2,793,444 | A | * | 5/1957 | Turner | 34/602 |
| 2,795,055 | A | * | 6/1957 | Huebsch | 34/82 |
| 2,798,304 | A | * | 7/1957 | Reiter | 34/91 |
| 2,798,306 | A | * | 7/1957 | Reiter | 34/609 |
| 2,802,283 | A | * | 8/1957 | Strike | 34/87 |
| 2,817,501 | A | * | 12/1957 | Schubert | 366/232 |
| 2,827,276 | A | * | 3/1958 | Racheter | 432/62 |
| 2,858,688 | A | * | 11/1958 | Smith | 68/20 |
| 2,864,250 | A | * | 12/1958 | Nichols | 68/19.1 |
| 2,867,107 | A | * | 1/1959 | Brown | 68/24 |
| 2,871,576 | A | * | 2/1959 | Ramey | 34/87 |
| 2,878,662 | A | * | 3/1959 | Brucken | 68/19.2 |
| 2,885,874 | A | * | 5/1959 | Polach | 66/140 R |
| 2,893,135 | A | * | 7/1959 | Smith | 34/610 |
| 2,925,663 | A | * | 2/1960 | Smith | 34/75 |
| 2,925,665 | A | * | 2/1960 | Smith | 34/82 |
| 2,931,149 | A | * | 4/1960 | Mitchell | 53/451 |
| 2,932,091 | A | * | 4/1960 | Day | 34/124 |
| 2,940,179 | A | * | 6/1960 | Czech | 34/77 |
| 2,958,139 | A | * | 11/1960 | Smith | 34/604 |
| 2,958,140 | A | * | 11/1960 | Smith | 34/598 |
| 2,959,867 | A | * | 11/1960 | Doty | 34/82 |
| 3,000,108 | A | * | 9/1961 | Jones et al. | 34/607 |
| 3,017,758 | A | * | 1/1962 | Haverstock et al. | 68/19 |
| 3,020,648 | A | * | 2/1962 | Strike | 34/599 |
| 3,022,580 | A | * | 2/1962 | Doty | 34/60 |
| 3,022,656 | A | * | 2/1962 | Bergeson et al. | 68/207 |
| 3,029,619 | A | * | 4/1962 | Lawson | 66/55 |
| 3,038,639 | A | * | 6/1962 | Anderson | 222/651 |
| 3,050,974 | A | * | 8/1962 | Smith | 68/20 |
| 3,064,361 | A | * | 11/1962 | Turner | 34/91 |
| 3,066,422 | A | * | 12/1962 | Douglas | 34/82 |
| 3,066,423 | A | * | 12/1962 | Solem | 34/86 |
| 3,084,531 | A | * | 4/1963 | Matheny | 68/210 |
| 3,099,542 | A | * | 7/1963 | Van Scoyk | 34/554 |
| 3,100,978 | A | * | 8/1963 | Howlett | 68/140 |
| 3,116,984 | A | * | 1/1964 | Decatur | 34/79 |
| 3,123,121 | A | * | 3/1964 | Katz | 152/214 |
| 3,125,485 | A | * | 3/1964 | Constantine et al. | 428/338 |
| 3,145,924 | A | * | 8/1964 | Rosener | 235/60.13 |
| 3,151,067 | A | * | 9/1964 | Ishoy | 210/144 |
| 3,177,592 | A | * | 4/1965 | Arnfried | 34/82 |
| 3,228,117 | A | * | 1/1966 | Floke | 34/126 |
| 3,231,909 | A | * | 2/1966 | Candor | 8/159 |
| 3,237,317 | A | * | 3/1966 | Heubsch, Sr. | 34/599 |
| 3,246,673 | A | * | 4/1966 | Heinrich | 139/1 E |
| 3,246,749 | A | * | 4/1966 | Moser | 209/17 |
| 3,251,448 | A | * | 5/1966 | Kienel | 194/211 |
| 3,281,304 | A | * | 10/1966 | Black | 156/351 |
| 3,318,745 | A | * | 5/1967 | Black | 156/111 |
| 3,320,678 | A | * | 5/1967 | Berke | 34/82 |
| 3,328,897 | A | * | 7/1967 | Purkett | 34/599 |
| 3,333,346 | A | * | 8/1967 | Brucken | 34/131 |
| 3,342,374 | A | * | 9/1967 | Kienel | 221/215 |
| 3,471,940 | A | * | 10/1969 | Smith | 34/603 |
| 3,584,394 | A | * | 6/1971 | Grabek | 34/599 |
| 3,601,903 | A | * | 8/1971 | Freze | 34/609 |
| 3,616,545 | A | * | 11/1971 | Jacobs | 34/599 |
| 3,643,341 | A | * | 2/1972 | Magin | 34/444 |
| 3,721,015 | A | * | 3/1973 | Sisler et al. | 34/601 |
| 3,729,834 | A | * | 5/1973 | Fox | 34/139 |
| 3,811,202 | A | * | 5/1974 | Arendt | 34/599 |
| 3,815,257 | A | * | 6/1974 | Freze | 34/129 |
| 3,815,258 | A | * | 6/1974 | Beard, Jr. | 34/602 |
| 3,816,070 | A | * | 6/1974 | Candor et al. | 8/158 |
| 3,840,998 | A | * | 10/1974 | Marcussen | 34/128 |
| 3,938,357 | A | * | 2/1976 | Leib | 69/23 |
| 3,946,500 | A | * | 3/1976 | Barrett et al. | 34/139 |
| 4,015,930 | A | * | 4/1977 | Grantham | 432/105 |
| 4,065,253 | A | * | 12/1977 | Bullock | 432/105 |
| 4,069,596 | A | * | 1/1978 | Sisler | 34/242 |
| 4,137,645 | A | * | 2/1979 | Bullock | 34/467 |
| 4,204,338 | A | * | 5/1980 | Bullock | 34/467 |
| 4,488,364 | A | * | 12/1984 | Herschel | 34/86 |
| 4,507,080 | A | * | 3/1985 | Freze | 432/105 |
| 4,519,145 | A | * | 5/1985 | Mandel | 34/389 |
| 4,615,125 | A | * | 10/1986 | Wyborn | 34/92 |
| 4,628,617 | A | * | 12/1986 | St. Louis | 34/108 |
| 4,677,760 | A | * | 7/1987 | St. Louis | 34/90 |
| 4,726,125 | A | * | 2/1988 | Pellerin | 34/82 |
| 4,817,298 | A | * | 4/1989 | Toma | 34/595 |
| 4,881,325 | A | * | 11/1989 | Jordan et al. | 34/60 |
| 4,989,347 | A | * | 2/1991 | Kretchman | 34/607 |
| 5,042,171 | A | * | 8/1991 | Obata et al. | 34/604 |
| 5,062,219 | A | * | 11/1991 | Harris et al. | 34/606 |
| 5,074,131 | A | * | 12/1991 | Hirose et al. | 68/19.2 |
| 5,107,606 | A | * | 4/1992 | Tsubaki et al. | 34/596 |
| 5,127,169 | A | * | 7/1992 | Ellingson | 34/601 |
| 5,207,764 | A | * | 5/1993 | Akabane et al. | 68/20 |
| 5,212,969 | A | * | 5/1993 | Tsubaki et al. | 68/19.2 |
| 5,220,734 | A | * | 6/1993 | Carver | 34/600 |
| 5,257,448 | A | * | 11/1993 | Pearce et al. | 29/434 |
| 5,371,956 | A | | 12/1994 | St. Louis | |
| 5,403,395 | A | * | 4/1995 | McCullough et al. | 118/19 |
| 5,421,103 | A | * | 6/1995 | Wunderlich | 34/599 |
| 5,433,091 | A | * | 7/1995 | Durazzani et al. | 68/140 |
| 5,438,766 | A | * | 8/1995 | Nakamura | 34/602 |
| 5,463,821 | A | * | 11/1995 | Gauer | 34/261 |
| D382,684 | S | * | 8/1997 | Jackovin | D32/25 |

| | | | | |
|---|---|---|---|---|
| 5,706,588 | A * | 1/1998 | Dausch et al. | 34/327 |
| 5,709,109 | A * | 1/1998 | Cho | 68/23.2 |
| 5,713,139 | A * | 2/1998 | Briggs | 34/602 |
| 5,749,163 | A * | 5/1998 | Staub et al. | 34/597 |
| 5,782,111 | A * | 7/1998 | Sights et al. | 68/142 |
| 5,802,886 | A * | 9/1998 | Kim | 68/142 |
| 5,819,437 | A * | 10/1998 | Briggs | 34/604 |
| 6,067,730 | A * | 5/2000 | Woods | 34/603 |
| 6,105,533 | A * | 8/2000 | Boos | 118/19 |
| 6,324,771 | B1 * | 12/2001 | McAllister et al. | 34/595 |
| 6,381,874 | B1 * | 5/2002 | Floyd | 34/602 |
| 6,401,362 | B1 * | 6/2002 | Schultz et al. | 34/499 |
| 6,434,857 | B1 * | 8/2002 | Anderson et al. | 34/595 |
| 6,698,107 | B2 * | 3/2004 | Song et al. | 34/595 |
| 6,745,495 | B1 * | 6/2004 | Riddle et al. | 34/497 |
| 6,751,888 | B2 * | 6/2004 | Lueckenbach | 34/595 |
| 6,941,679 | B1 * | 9/2005 | Harris et al. | 34/596 |
| 6,954,992 | B2 * | 10/2005 | Hwang | 34/108 |
| 6,954,995 | B2 * | 10/2005 | Kitamura et al. | 34/597 |
| 6,968,632 | B2 * | 11/2005 | Guinibert et al. | 34/602 |
| 6,995,965 | B2 * | 2/2006 | Hameed et al. | 361/91.1 |
| 7,007,955 | B2 * | 3/2006 | Cross et al. | 277/652 |
| 7,024,802 | B2 * | 4/2006 | Myung | 34/604 |
| 7,036,243 | B2 * | 5/2006 | Doh et al. | 34/595 |
| 7,055,262 | B2 * | 6/2006 | Goldberg et al. | 34/86 |
| 7,065,904 | B2 * | 6/2006 | Lee et al. | 34/601 |
| 7,065,905 | B2 * | 6/2006 | Guinibert et al. | 34/603 |
| 7,093,377 | B2 * | 8/2006 | Doh et al. | 34/596 |
| 7,194,824 | B2 * | 3/2007 | Wang | 34/602 |
| 7,207,124 | B2 * | 4/2007 | Kim | 34/601 |
| 7,213,348 | B2 * | 5/2007 | Ackermann et al. | 34/86 |
| 7,225,562 | B2 * | 6/2007 | Guinibert et al. | 34/601 |
| 7,257,905 | B2 * | 8/2007 | Guinibert et al. | 34/82 |
| 7,263,787 | B2 * | 9/2007 | Besaw | 34/62 |
| 7,322,126 | B2 * | 1/2008 | Beaulac | 34/554 |
| 7,322,127 | B2 * | 1/2008 | Hwang | 34/603 |
| 7,340,849 | B2 * | 3/2008 | Kim | 34/602 |
| 7,395,612 | B2 * | 7/2008 | Jeong et al. | 34/602 |
| 7,395,684 | B2 * | 7/2008 | Ozturk | 68/142 |
| 7,406,780 | B2 * | 8/2008 | Doh et al. | 34/606 |
| 7,421,803 | B2 * | 9/2008 | Charron | 34/380 |
| 7,467,483 | B2 * | 12/2008 | Guinibert et al. | 34/601 |
| 7,627,960 | B2 * | 12/2009 | Beyerle et al. | 34/602 |
| 7,661,203 | B2 * | 2/2010 | Fumagalli | 34/596 |
| 2003/0000106 | A1 * | 1/2003 | Anderson et al. | 34/598 |
| 2004/0060196 | A1 * | 4/2004 | Lueckenbach | 34/595 |
| 2004/0103556 | A1 * | 6/2004 | Bang | 34/595 |
| 2004/0107598 | A1 * | 6/2004 | Hwang | 34/601 |
| 2004/0111916 | A1 * | 6/2004 | Hwang | 34/601 |
| 2004/0123486 | A1 * | 7/2004 | Hameed et al. | 34/595 |
| 2004/0200093 | A1 * | 10/2004 | Wunderlin et al. | 34/606 |
| 2004/0216326 | A1 * | 11/2004 | Kitamura et al. | 34/597 |
| 2004/0261288 | A1 * | 12/2004 | Beyerle et al. | 34/602 |
| 2005/0028400 | A1 * | 2/2005 | Matteson | 34/595 |
| 2005/0076535 | A1 * | 4/2005 | Guinibert et al. | 34/601 |
| 2005/0102853 | A1 * | 5/2005 | Wang | 34/602 |
| 2005/0102854 | A1 * | 5/2005 | Lee et al. | 34/602 |
| 2005/0115104 | A1 * | 6/2005 | Guinibert et al. | 34/601 |
| 2005/0120585 | A1 * | 6/2005 | Lee et al. | 34/602 |
| 2005/0120586 | A1 * | 6/2005 | Hwang et al. | 34/603 |
| 2005/0126034 | A1 * | 6/2005 | Jeong et al. | 34/602 |
| 2005/0126035 | A1 * | 6/2005 | Lee et al. | 34/602 |
| 2005/0132594 | A1 * | 6/2005 | Doh et al. | 34/73 |
| 2005/0132600 | A1 * | 6/2005 | Myung | 34/601 |
| 2005/0132604 | A1 * | 6/2005 | Hong et al. | 34/603 |
| 2005/0166421 | A1 * | 8/2005 | Doh et al. | 34/603 |
| 2005/0183284 | A1 * | 8/2005 | Hwang et al. | 34/603 |
| 2006/0130358 | A1 * | 6/2006 | Kim | 34/494 |
| 2006/0236560 | A1 * | 10/2006 | Doh et al. | 34/596 |
| 2006/0265899 | A1 * | 11/2006 | Renzo | 34/603 |
| 2007/0006477 | A1 * | 1/2007 | Guinibert et al. | 34/85 |
| 2007/0017119 | A1 * | 1/2007 | Besaw | 34/602 |
| 2007/0074419 | A1 * | 4/2007 | Starrett | 34/242 |
| 2007/0186440 | A1 * | 8/2007 | Guinibert et al. | 34/603 |
| 2007/0220776 | A1 * | 9/2007 | Guinibert et al. | 34/603 |
| 2007/0227031 | A1 * | 10/2007 | Yoon | 34/242 |
| 2007/0256322 | A1 * | 11/2007 | Kim et al. | 34/603 |
| 2008/0022551 | A1 * | 1/2008 | Banta et al. | 34/602 |
| 2008/0022552 | A1 * | 1/2008 | Forget | 34/602 |
| 2008/0141558 | A1 * | 6/2008 | Bae et al. | 34/595 |
| 2009/0056161 | A1 * | 3/2009 | Ahn et al. | 34/79 |

FOREIGN PATENT DOCUMENTS

| | | | | |
|---|---|---|---|---|
| DE | 198 21 366 | | | 8/1999 |
| EP | 600671 | A1 | * | 6/1994 |
| EP | 1001068 | A1 | * | 5/2000 |
| EP | 1433887 | A1 | * | 6/2004 |
| EP | 1433888 | A1 | * | 6/2004 |
| EP | 1679400 | A1 | * | 7/2006 |
| EP | 1775367 | A1 | * | 4/2007 |
| GB | 2063439 | A | * | 6/1981 |
| GB | 2063440 | A | * | 6/1981 |
| GB | 2063441 | A | * | 6/1981 |
| JP | 01249097 | A | * | 10/1989 |
| JP | 01249098 | A | * | 10/1989 |
| JP | 02-063500 | | | 3/1990 |
| JP | 02077292 | A | * | 3/1990 |
| JP | 02249590 | A | * | 10/1990 |
| JP | 02252495 | A | * | 10/1990 |
| JP | 03037093 | A | * | 2/1991 |
| JP | 03244498 | A | * | 10/1991 |
| JP | 04240494 | A | * | 8/1992 |
| JP | 04259493 | A | * | 9/1992 |
| JP | 04307096 | A | * | 10/1992 |
| JP | 05031297 | A | * | 2/1993 |
| JP | 05084385 | A | * | 4/1993 |
| JP | 05245294 | A | * | 9/1993 |
| JP | 06121898 | A | * | 5/1994 |
| JP | 06190192 | A | * | 7/1994 |
| JP | 07275584 | A | * | 10/1995 |
| JP | 07275585 | A | * | 10/1995 |
| JP | 07275586 | A | * | 10/1995 |
| JP | 08024494 | A | * | 1/1996 |
| JP | 08024497 | A | * | 1/1996 |
| JP | 08103596 | A | * | 4/1996 |
| JP | 08164290 | A | * | 6/1996 |
| JP | 08332300 | A | * | 12/1996 |
| JP | 09248397 | A | * | 9/1997 |
| JP | 10328495 | A | * | 12/1998 |
| JP | 11179100 | A | * | 7/1999 |
| JP | 2000167294 | A | * | 6/2000 |
| JP | 2000300887 | A | * | 10/2000 |
| JP | 2003019396 | A | * | 1/2003 |
| JP | 2003117286 | A | * | 4/2003 |
| JP | 2004209208 | A | * | 7/2004 |
| JP | 2005065921 | A | * | 3/2005 |
| JP | 2005218610 | A | * | 8/2005 |
| JP | 2009077782 | A | * | 4/2009 |
| WO | WO 03/087459 | | | 4/2003 |

* cited by examiner

[Fig. 1]
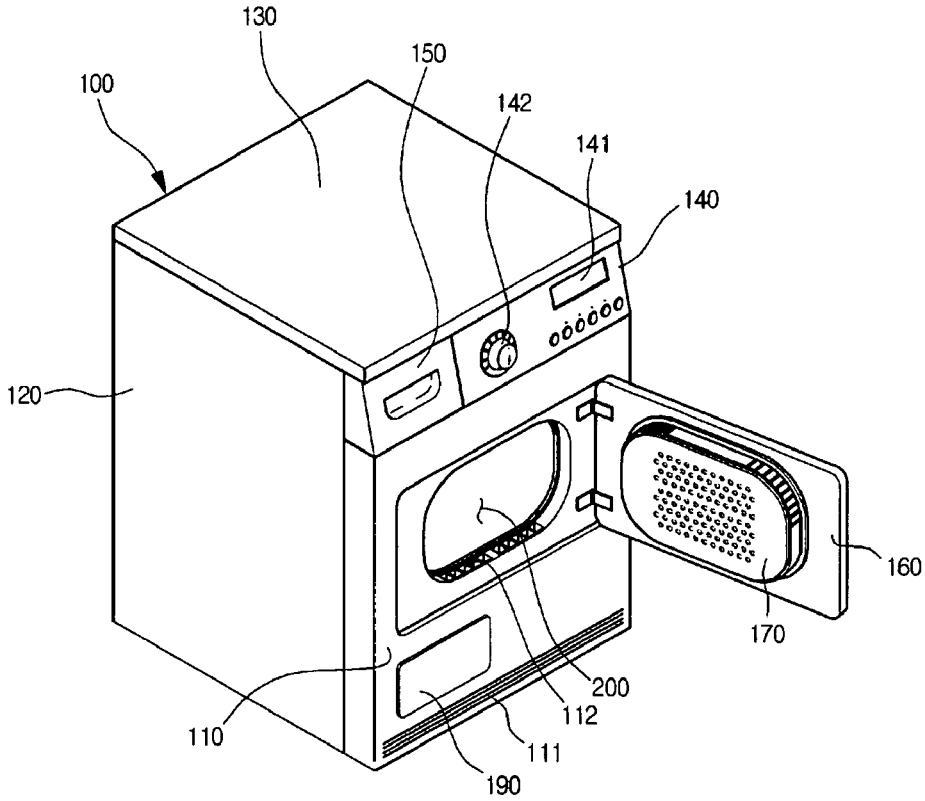
[Fig. 2]
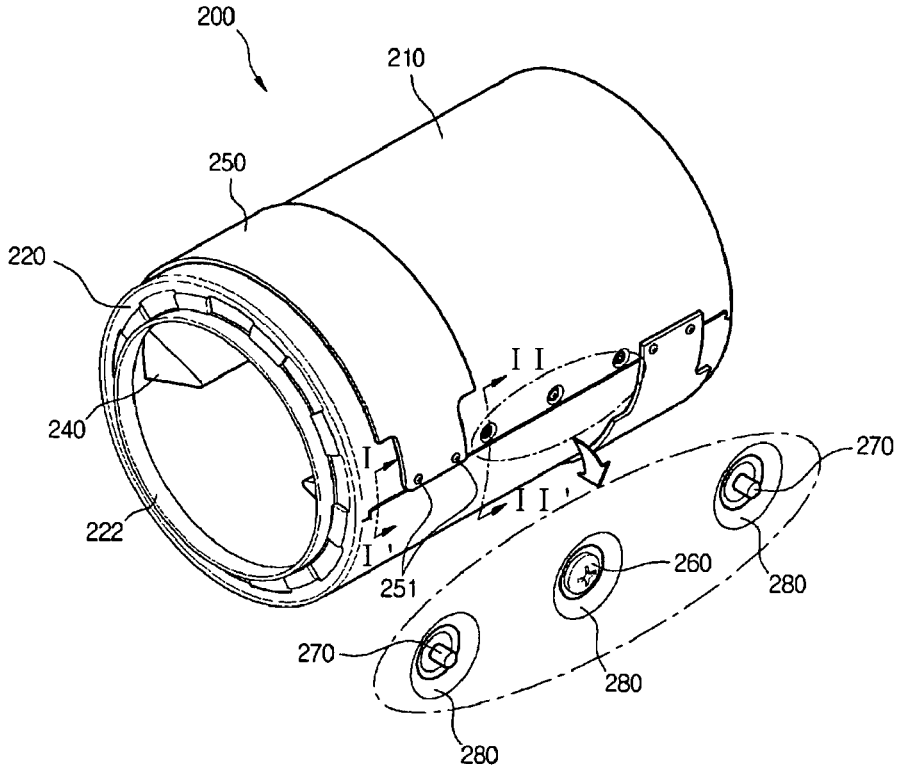

[Fig. 3]
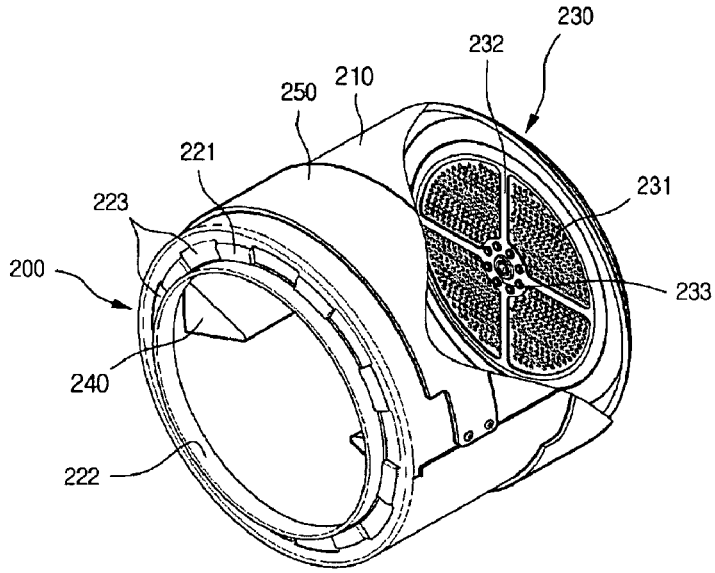
[Fig. 4]
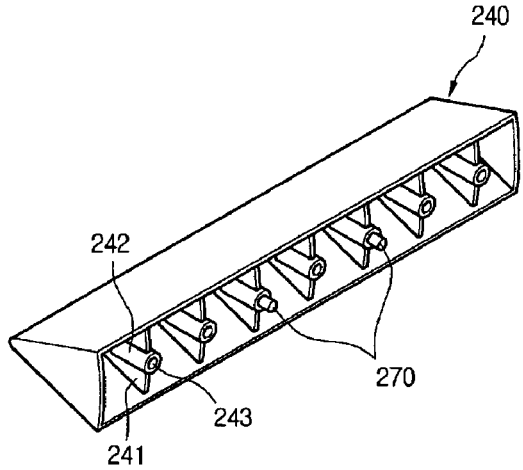
[Fig. 5]
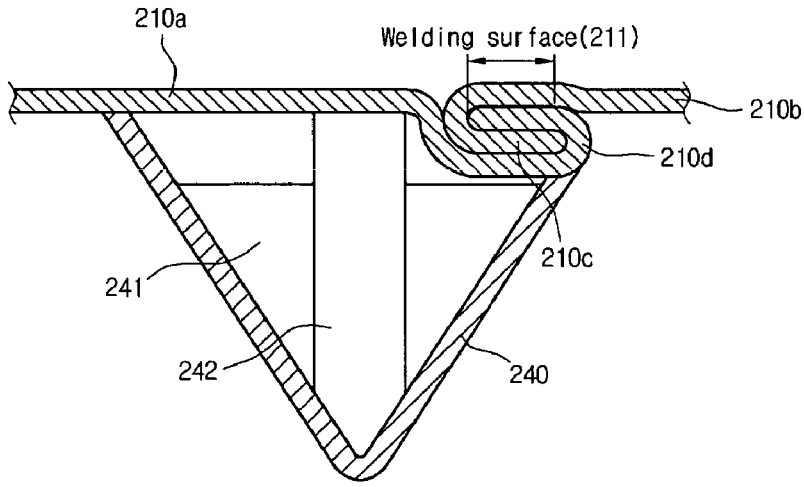

[Fig. 6]
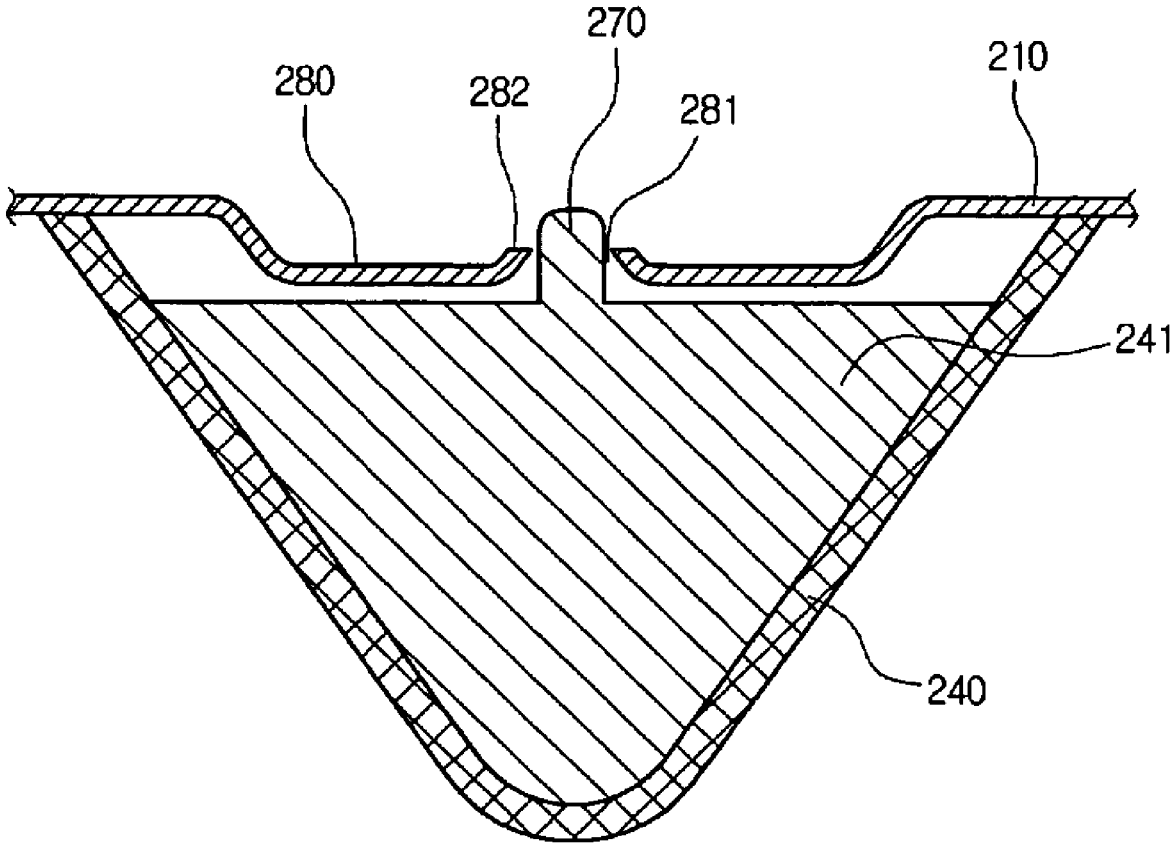

DRUM OF LAUNDRY DRYER

This application claims the benefit of International Application No. PCT/KR2005/001539, filed on May 25, 2005 and Korean Application No. 2004-0041111, filed on Jun. 5, 2004, which are hereby incorporated by reference as if fully set forth herein.

TECHNICAL FIELD

The present invention relates to a laundry dryer, and more particularly, to a drum assembly of a laundry dryer, which can enhance the strength of a drum mounted in the dryer and allow the drum to be assembled to have a flowing outer surface.

BACKGROUND ART

A laundry dryer is an electronic appliance that can dry wet laundry by supplying a high temperature and dry hot wind into a drum in which the wet laundry is stored.

There is an increasing demand for such laundry dryers.

That is, the laundry dryer is designed to dry the laundry using the hot wind while lifting and dropping the laundry loaded in a drum rotating by a driving motor. The laundry dryer may be classified into an exhaust-type dryer and a condenser-type dryer. The former is designed such that high-temperature and humidity air absorbing moisture from the laundry in the drum is exhausted out of the dryer. The latter is designed such that the air circulating in the dryer absorbs the moisture from the laundry loaded in the drum.

In addition, the laundry dryer includes a dry drum in which the wet laundry is loaded and a heater and blower fan for supplying hot wind into the dry drum. A lift is mounted on an inner circumference of the dry drum to lift the laundry loaded in the drum when the dry drum rotates at a high speed. The laundry drum is provided at a front surface with an opening through which the laundry is loaded therein. An inner circumference defining the opening is supported by a front cover defining the front surface of the laundry dryer. The dry drum may be designed such that a rear surface thereof may integrally rotate together with a cylindrical main body of the dry drum. Alternatively, the dry drum may be designed such that the rear surface thereof may be fixed on a back cover so that only the cylindrical main body of the dry drum can rotate alone.

When the dry drum is designed such that the rear surface thereof rotates together with the cylindrical main body of the dry drum, the dry drum is formed by rolling up a single metal plate into a cylindrical shape and welding the metal plate. The front opening of the dry drum is supported on a rear surface of the front cover and the rear surface of the dry drum is supported on a back cover by a journal bearing.

When the dry drum is formed of the single metal plate, there is a problem in that the thickness of the metal plate should be increased to endure the load of the drum at both ends.

In addition, a coupling member is inserted penetrating the dry drum to couple the lift on the inner circumference of the dry drum. At this point, since an outer end of the coupling member is projected from the outer circumference of the dry drum, the projected outer end may interfere with a belt wound around the outer circumference of the dry drum. That is, by the projected outer end, the belt may be damaged or torn up.

In addition, a penetration hole is formed on the dry drum so that the coupling member penetrates therethrough. In this case, by burrs generated during the penetration hole forming process, the coupling member may be easily inserted into the fenestration hole.

Furthermore, the main body of the dry drum is formed by rolling up a rectangular plate and welding opposite ends of the plate. At this point, the welding portion may be projected from the outer circumference of the drum, conflicting with the belt.

DISCLOSURE OF INVENTION

Technical Problem

The present invention has been made in an effort to solve the above-described problems. It is an object of the present invention to provide a drum assembly of a laundry dryer, which can be made by a thin plate and designed to effectively endure the load applied by the drum itself as well as the laundry loaded in the drum.

Another object of the present invention is to provide a drum assembly of a laundry dryer, which can minimize the damage of a belt wound around an outer circumference of the drum by improving a bonding structure of a drum main body.

Another object of the present invention is to provide a drum assembly of a laundry dryer, which is designed to easily mount a lift on an inner circumference of the dry drum and prevent a coupling member coupling the lift on the inner circumference of the dry drum from interfering with the belt.

Technical Solution

To achieve the above objects, the present invention provides a drum assembly of a laundry dryer, comprising: a cylindrical drum main body formed through a seam-welding process; a drum head comprising a main head rim having a predetermined width in a direction toward a center of the drum main body, the main head rim being coupled to a first end of the drum main body and provided with a plurality of elevated portion, and a support sleeve bent from an end of the main head rim; a drum rear wall coupled to a second end of the drum main body and provided with a plurality of hot wind introducing holes; and a lift coupled to an inner circumference of the drum main body to lift the laundry.

According to another aspect of the present invention, there is provided a drum assembly of a laundry dryer, comprising: a cylindrical drum main body provided with at least one coupling hole; a drum head coupled to a first end of the drum main body; a drum rear wall coupled to a second end of the drum main body; and a lift mounted on an inner circumference of the drum main body and provided at a bottom surface with positioning projection inserted in the coupling hole and with a boss in which a coupling member is inserted.

Advantageous Effects

According to the inventive drum assembly of the present invention, since the dry drum is formed of three parts, i.e., a drum head, a drum main body and a drum rear wall, a thickness of the drum, which is required for supporting the load of the drum and the laundry, can be reduced.

In addition, since the drum head of the dry drum is embossed to enhance the strength, more laundry can be loaded in the drum.

Furthermore, since the welding portion formed on an outer surface of the dry drum main body is depressed inward of the drum, the outer circumference of the dry drum can be smoothly formed, thereby preventing the welding portion from conflicting with the belt.

BRIEF DESCRIPTION OF THE DRAWINGS

FIG. 1 is an outer perspective view of a laundry dryer where a drum assembly of the present invention is employed;

FIG. 2 is an outer perspective view of a drum assembly according to one embodiment of the present invention;

FIG. 3 is a partly broken perspective view of a drum depicted in FIG. 2;

FIG. 4 is a perspective view of a lift according to one embodiment of the present invention;

FIG. 5 is a sectional view taken along lines I-I' of FIG. 1; and

FIG. 6 is a sectional view taken along lines II-II' of FIG. 2.

BEST MODE FOR CARRYING OUT THE INVENTION

Reference will now be made in detail to the preferred embodiments of the present invention. It is to be understood that the following detailed description of the present invention does not limit the present invention but various modifications and variations can be made in the present invention. Thus, it is intended that the present invention covers the modifications and variations of this invention provided they come within the scope of the present invention.

FIG. 1 is an outer perspective view of a laundry dryer where a drum assembly of the present invention is employed.

Referring to FIG. 1, a laundry dryer 100 with the inventive drum assembly includes a front cover 110 defining an outer appearance of the dryer 100, side and top covers 120 and 130, and a control panel disposed on an upper portion of the front cover and having a dial knob 142 for inputting a drying condition and a display unit 141.

A drawer 150 for storing condensed water generated during the drying process is inserted in a portion of the control panel 140. The front cover 110 is provided at a center with an opening. A door 160 is pivotally mounted on the front surface of the front cover 110 to open and close the opening of the front cover 110. A door lint filter 170 is mounted on a rear surface of the door 160 to filter foreign objects such as naps generated during the drying process. A body lint filter 112 is formed on a lower end of the opening, which contacts a lower end of the door lint filter 170.

The dryer 100 includes a drum 200 received therein, a condenser receiving portion 180 formed on a lower portion of the front cover 110, and a suction grill 111 formed on the lower portion of the front cover 110 under the condenser receiving portion 180.

Describing the operation of the above-described dryer 100, a belt (not shown) is wound around the outer circumference of the drum 200 and connected to a motor (not shown) mounted under the drum 200. Therefore, when the motor is driven, the drum 200 rotates. As the drum 200 rotates, the laundry 200 in the drum is repeatedly lifted to the highest point and fallen. The high-temperature/dry air introduced through the rear wall of the drum 200 absorbs the moisture contained in the laundry.

Meanwhile, the air changed into the high-temperature/damp air by absorbing the moisture from the laundry passes through the door lint filter 170 and the body lint filter 112, in the course of which foreign objects contained in the air are filtered. Then, the high-temperature/damp air passes through the condenser (not shown) to be changed into condensed water. The condensed water is collected in the drawer 150.

FIG. 2 is an outer perspective view of a drum assembly according to one embodiment of the present invention.

Referring to FIGS. 2 and 3, the drum includes a drum main body 210 formed by rolling up a rectangular plate in a cylindrical shape and bonding opposite ends of the plate, a drum head 220 attached on a first end of the drum main body 210, and a drum rear wall 230 attached on a second end of the drum main body 210.

The drum main body 210 is formed in the cylindrical shape through the seaming process. The drum head 220 and the drum rear wall 230 are also coupled to the first and second ends of the drum main body 210 through the seaming process, respectively. The coupling process of the drum head 220 and the drum rear wall 230 to the drum main body 210 is not limited to the seaming process. That is, a variety of other welding methods can be used. The coupling process of the drum main body 210 will be described later.

At least one lift 240 is mounted on the inner circumference of the drum main body 210. The lift 240 is fixed on the inner circumference of the drum main body 200 by a coupling member 260 penetrating into the drum main body 210 from the outer surface of the drum main body 210. A positioning projection 270 formed on a bottom surface of the lift 240 penetrates the drum main body 210 so that the lift 240 can be positioned on the right location on the drum main body 210.

In addition, at least one soundproofing belt 250 is attached on the outer circumference of the drum main body 210 to attenuate noise generated when hard objects such as coins collides with the drum. The soundproofing belt 250 is coupled to the drum main body 210 by a coupling member 251. The coupling method of the soundproofing belt 250 is not limited to this. For example, a double-sided tape or adhesive may be used.

The drum main body 210 is provided with a penetration hole through which the positioning projection 270 is inserted. The penetration hole is depressed by a predetermined depth from the outer circumference of the drum main body 210. That is, a circular-shaped conflicting prevention groove 280 is formed around the penetration hole so that the position projection 270 cannot be projected from the outer circumference of the drum main body 210 even when the position projection 270 penetrates the penetration hole. Another conflicting prevention groove 280 is formed on the outer circumference of the drum main body 210 between the positioning projections 270 at a center of which a penetration hole is formed. The coupling member 260 is inserted through the penetration hole to couple the lift 240 to the inner circumference of the drum main body. In this case, since the conflicting prevention groove 280 is depressed by a predetermined depth, a head portion of the coupling member 260 is not projected, thereby not conflicting with the belt wound around the outer circumference of the drum 200. The structure of the lift will be described with reference to the accompanying drawings later.

In addition, the drum head 220 is formed in a circular strip having a predetermined width. An outer edge of the drum head 220 is coupled to the first end of the drum main body 210. The drum head 220 includes a main head rim 221 formed extending inward from the drum main body 210 and having a predetermined width and a front support sleeve 222 bent from an end of the main head rim 221 in parallel with a central axis of the drum 200. That is, the main head rim 221 and the front support sleeve 22 are disposed to be perpendicular to each other.

Namely, the front support sleeve 222 is disposed on an outer circumference of a drum support (not shown) mounted on a rear surface of the front cover 110. The drum support is provided with a circular projection having a diameter identical to an inner diameter of the front support sleeve 222 so that the front support sleeve 22 rotates in a state where it is inserted around the outer circumference of the circular projection. A friction preventing member such as a pelt is disposed around the outer circumference of the circular projection to minimize the frictional heat generated when the front support sleeve 222 contacts the circular projection.

In addition, a diameter of the front support sleeve 222 is less than a diameter of the drum main body 210. Therefore, the loads of the drum 200 and laundry loaded in the drum 200 is transmitted through the main head rim 221.

The main head rim 221 is provided with at least one elevated portion 223 formed through a forming process. Preferably, the elevated portion 223 is provided in plurality that are arranged at a predetermined distance from each other.

Since the loads of the drum main body 210 and the laundry is concentrated on the main head rim 221, the loads applied to the main head rim 221 are uniformly distributed. The elevated portion 223 are formed to enhance the strength of the main head rim 221. Therefore, a thickness of the main head rim 221 can be reduced as compared with a case it is formed without the elevated portion 223.

Meanwhile, the drum rear wall 230 is provided with a plurality of hot wind introducing holes 231. The high-temperature/dry air is introduced from a dry duct (not shown) into the drum 20 through the hot wind introducing holes 231. A journal bearing 233 for supporting the load of the drum 200 is rotatably mounted on a center portion of the drum rear wall 230. A distal end of the journal bearing 233 is supported by a back cover (not shown) of the dryer 100. The hot wind introducing holes 231 may cause the strength of the drum rear wall 230 to be weakened, thereby deforming the drum rear wall 230. To solve this problem, the strength reinforcing embossments 232 are formed on the drum rear wall 230 and arranged in a radial direction from the center portion thereof. The embossments 232 function to distribute the loads concentrated on the journal bearing 233.

FIG. 4 is a perspective view of a lift according to an embodiment of the present invention.

Referring to FIG. 1, as described above, the lift 240 is mounted on the inner circumference of the drum 200 to be in parallel with a central axis of the drum 200.

The lift 240 is designed having a triangular section and mounted on the inner circumference of the drum 200 such that a peak of thereof is oriented toward the central axis of the drum.

A plurality of strength reinforcing ribs 241 are arranged in the lift 240 and spaced from each other by a predetermined distance. A boss 242 in which the coupling member is inserted is formed on a center of each rib 241. The boss 242 is provided at a center with an insertion hole 243 in which the coupling member can be inserted.

In addition, some of the bosses 242 are provided at there front ends with the respective positioning projections 270 that will be inserted into the penetration holes formed on the drum main body 210.

By the coupling bosses penetrating the drum main body 210 and inserted into the insertion holes 242 of the bosses 242, the lift 240 is fixed on the inner circumference of the drum 200. Before the coupling members are inserted in the insertion holes 243, the location of the lift 240 is determined by the position projections 270.

FIG. 5 is a sectional view taken along line I-I' of FIG. 1.

Referring to FIG. 5, opposite circumferential ends of the drum main body 210 are bonded each other by a seam-welding process.

That is, the seam-welding is one of electric resistance welding methods, which performs the point-welding using a roller type electrode. This seal-welding is very effect for forming a seam requiring airtightness and watertightness.

Describing the seal-welding process, first and second circumferential end portions 210*a* and 210*b* of the drum main body 210 contact each other to form a welding surface 211 having a predetermined width. The roller type electrode depresses the outer surface of the joint portion between the first and second circumferential end portions 210*a* and 210*b* of the drum main body 210.

Here, the second circumferential end portion 210*b* of the drum main body 210 is provided with a folded end 210*c* that is located over the first end portion 210*a* of the drum main body 210 by a predetermined length. That is, the first end portion 210*a* closely contacts a portion distant from an extreme end of the second end portion 210*b* at a predetermined interval. The folded end 210*c* is folded as in the drawing. The welding portion is folded such that a folded end 210*c* closely contacts the first end portion 210*a* with reference to a bent end 210*d* of the first end portion 210*a* of the drum main body 210. Here, the bent end 210*d* is a point where an extreme end of a folded end 210*c* contacts the first end portion 210*a*.

According to a feature of the present invention, the welding portion including the folded end 210*c* of the drum main body 210 is depressed into the drum 200 through the seam-welding process. Thus, the outer circumference of the drum 200 can be smoothly processed without any protruded portion. As a result, the belt wound around the outer circumference of the drum 200 is not damaged when the drum rotates. The welding portion depressed into the drum 200 is covered by the lift 240, no laundry is caught by the welding portion, thereby preventing the laundry from being damaged.

FIG. 6 is a sectional view taken along line II-II' of FIG. 2.

Referring to FIG. 6, the lift is mounted on the inner circumference of the drum 200. As the drum 200 rotates, the laundry 200 in the drum 200 is repeatedly lifted to the highest point and fallen.

As described above, the lift 240 is designed having a triangular section and, as shown in the drawing, at least one positioning projection 270. Between the positioning projections, the boss (refer to the reference numeral 242 of FIG. 4) in which the coupling member 260 is inserted is formed. The strength reinforcing rib 241 is formed on each outer circumference of the positioning projection 270 and the boss 242 so as to prevent the projection 270 and the boss 242 are not inclined to a side.

The drum main body 210 is provided with the conflicting prevention groove 280 having a predetermined diameter is formed. The conflicting prevention groove 280 is provided at a center with the penetration hole 281 in which the positioning projection 270 is inserted. That is, the positioning projection 270 is inserted into the penetration hole 281 formed on the drum main body 210. Describing in more detail, the conflicting prevention groove 280 is slightly depressed from the surface of the drum main body 210 to prevent the positioning projection 270 from interfering with the belt wound around the outer circumference of the drum 200.

A bent portion 282 is formed on an inner circumference defining the penetration hole 281. The bent potion 282 is bent in a direction where the positioning projection 270 is inserted into the penetration hole 281 from the inner circumference to the outer circumference.

Generally, when a work piece is cut of by, for example, sawing, burrs are generated on the processed surface. Such burrs are also generated on the inner circumference of a hole during a punching process. When the burrs are formed on the penetration hole, it becomes difficult to insert the coupling member into the penetration hole.

To solve this problem, in the present invention, the bent end 282 defining the penetration hole 281 is designed to be bent outward so that the positioning projection 270 can be smoothly inserted through the penetration hole 281 without conflicting therewith.

Meanwhile, the height of the bent end 282 is set to be lower than a depth of the groove 280 so as to prevent the belt wound around the outer circumference of the drum 200 from being damaged by the bent end 281.

INDUSTRIAL APPLICABILITY

According to the inventive drum assembly, since a thickness of the drum can be reduced, the manufacturing costs can be saved. In addition, since the rotational belt wound around the outer circumference of the drum is not damaged by the coupling member or positioning projection, the endurance of the product can be improved. Therefore, the inventive drum assembly has a very high industrial applicability.

The invention claimed is:

1. A drum assembly of a laundry dryer, comprising:

a cylindrical drum main body that is formed through a seam-welding process, the seam-weld being located only on the cylindrical portion of the drum main body;

a drum head comprising a main head rim having a predetermined width in a direction toward a rotating shaft of the drum main body, the main head rim being coupled to a first end of the drum main body and provided with a plurality of elevated portions, and a support sleeve bent outwards from an end of the main head rim;

a drum rear wall coupled to a second end of the drum main body and provided with a plurality of hot wind introducing holes; and a lift coupled to an inner circumference of the drum main body to lift the laundry, wherein the cylindrical portion is provided with at least one penetration hole that is a predetermined distance apart from the first end and the second end of the drum main body, and wherein the lift is provided at a bottom surface with a positioning projection to be inserted into the penetration hole.

2. The drum assembly according to claim 1, wherein the elevated portion is formed through a forming process.

3. The drum assembly according to claim 1, wherein the drum main body is provided with a welding portion that is depressed into the drum main body to smoothly form the outer circumference of the drum main body.

4. The drum assembly according to claim 1, wherein a portion where the penetration hole is formed is depressed from an outer circumference of the drum main body.

5. The drum assembly according to claim 1, wherein the drum main body, the drum head and the drum rear wall are coupled to each other through a seam-welding process.

6. The drum assembly according to claim 1, wherein an inner circumference defining the penetration hole in which the positioning projection is inserted is bent outward of the drum main body.

7. The drum assembly according to claim 1, wherein a portion where the penetration hole is formed is depressed to define a conflicting prevention groove.

8. The drum assembly according to claim 7, wherein a length of the positioning projection passing through the penetration hole is equal to or less than a depth of the conflicting prevention groove.

9. The drum assembly according to claim 1, wherein an extreme end of the positioning projection passing through the penetration hole is located to be lower than an outer circumference of the drum main body.

10. The drum assembly according to claim 1, wherein the lift is fixed on the drum main body by a coupling member penetrating the coupling hole and inserted in a boss, the boss being provided in the inside of the lift.

11. The drum assembly according to claim 10, wherein a head portion of the coupling member is located to be lower than an outer circumference of the drum main body.

12. The drum assembly according to claim 1, wherein the plurality of elevated portions are positioned perpendicular to the support sleeve.

* * * * *